US005632573A

United States Patent [19]

Baker

[11] Patent Number: 5,632,573

[45] Date of Patent: May 27, 1997

[54] WALL-LIKE RETAINER SEGMENTS FOR RETAINING LIQUIDS

[76] Inventor: Leroy O. Baker, 612 Hemlock St., Midland, Mich. 48642-6337

[21] Appl. No.: 521,779

[22] Filed: Aug. 31, 1995

[51] Int. Cl.[6] ..... E02B 3/04

[52] U.S. Cl. ..... 405/111; 405/114

[58] Field of Search ..... 405/52, 107, 111, 405/112, 114; 404/6

[56] References Cited

U.S. PATENT DOCUMENTS 1,077,791 12/1913 Glaauw .
3,213,628 10/1965 Serota ..... 405/111
4,031,676 6/1977 Dally .
4,650,368 3/1987 Bayer ..... 405/111
4,978,245 12/1990 White ..... 404/6
5,176,468 1/1993 Poole ..... 405/111 X
5,464,306 11/1995 Cristiano ..... 404/6
5,531,540 7/1996 Wasserstrom et al. ..... 404/6

*Primary Examiner*—William P. Neuder
*Attorney, Agent, or Firm*—Robert L. McKellar

[57] ABSTRACT

What is disclosed herein is a novel device for retaining liquids, such as water, such as in the control of flood waters. Also disclosed is its utility as a portable wall system which can be used to build support structures for swimming pools, synthetic watering ponds for animals, such as cattle, water storage for crops, and for water intended to be a source for fire use.

7 Claims, 1 Drawing Sheet

WALL-LIKE RETAINER SEGMENTS FOR RETAINING LIQUIDS

This invention deals with a novel device for retaining liquids, such as water, such as in the control of flood waters.

This invention also has utility as a portable wall system which can be used to build support structures for swimming pools, synthetic watering ponds for animals, such as cattle, water storage for crops, and for water intended to be a source for fire use.

The devices of this invention provide a wall-like structure for the above described purposes, among others, and is configured to be easily erected and dismantled and transported from site to site. It is intended that the devices of this invention can be used for these purposes, but it is also contemplated within the scope of this invention to use these devices in conjunction with sand bags, gravel, or other fill materials, for example, to control flood waters.

BACKGROUND OF THE INVENTION

Although the inventor herein is not aware of any device that is similar in appearance or function to the devices of the instant invention, there is at least two patents dealing with the containment or control of water.

U.S. Pat. No. 1,077,791 to Glaauw, Issued Nov. 4, 1913 describes a cellular dam. The dam is constructed of independent cells which can be filled with water to provide weight to the dam site and provide a containment for the water above such a dam. The object of the invention is to provide hollow cells that can be filled with water to provide weight, but which occupy space in the dam configuration that would normally be filled with concrete or the like, thus cutting down on the amount of concrete that needs to be used to construct the dam. The Glaauw invention also provides a filling pipe on the upside of the stream and an overflow pipe on the down side of the stream and also provides conduits which connect the individual cells together. This disclosure is distinguished by virtue of the fact that at the very least, the components of the patented dam do not appear to be portable, and in fact, are covered with concrete or earth, and do not provide a barrier per se to the water. Such a barrier is provided only in conjunction with concrete or some other type of barrier.

U.S. Pat. 4,031,676, issued Jun. 28, 1977 to Dally, discloses a water blocking device which is a triangular-shaped structure in two different shapes which may be interlocked to form small dam-like barriers. Although highly portable, and interconnectable, this device does not provide a weighting system which would hold the device in place, and therefore, it can only be used for minor containment of water and the like.

THE INVENTION

This invention consists of several segments of wall-like structure that can be coupled together to make a dam or supporting wall for containment of liquids and which finds its weight by filling with water or other liquid.

One of the primary objectives of this invention is to provide a wall-like system that is highly portable so that it can be used, dismantled, and moved to another site with a minimum of time and expense associated with such a move.

Another objective of this invention is to provide a low cost system for the containment or control of liquids.

Yet another objective of this invention is to provide the means for building a supporting structure for the containment of water such as a pond or pool.

Still another objective of this invention is to provide a low cost system that can be used to restructure embankments along the edges of creeks, streams, and rivers, or along road sides, i.e. revetment.

Thus, there is provided a wall-like retainer segment comprising a generally rectangular hollow body having a top wall, a bottom wall, a front wall having a horizontal median line, a back wall, a post end wall and an opposite end wall.

The top wall has two, essentially identical openings through it, each of said openings being located near each of the ends, and the bottom wall has two, essentially identical openings through it and each bottom opening is in vertical alignment with one of the top openings. The post end wall has vertically fixed to it, a rounded post.

The opposite end wall has a vertically aligned post opening in it, and the front wall has two, essentially identical openings through it. The front wall openings are located above the front wall horizontal median line. The back wall has two vertically aligned post openings in it, each said back wall vertically aligned post opening being located between an end wall and the top opening near that end wall.

There is further provided as an embodiment of this invention, a wall-like retainer segment having no openings in its front wall, comprising a generally rectangular hollow body having a top wall, a bottom wall, a front wall, a back wall, a post end wall and an opposite end wall.

The top wall has two, essentially identical openings through it, and each of the openings is located near each of the ends, and the bottom wall has two, essentially identical openings through it, each bottom opening being in vertical alignment with one of the top openings.

The post end wall has vertically attached to it, a rounded post, and the opposite end wall has a vertically aligned post opening in it.

The back wall has two vertically aligned post openings in it, and each of the back wall vertically aligned post openings is located between an end wall and the top opening near that end wall.

Still further, there is provided a support for a wall-like retainer segment wherein the support has a bottom wall, the bottom wall having a back end and a front end, a back wall having a top and a bottom and a back, an inclined front wall having an upper end and a lower end and two, essentially identical, side walls.

The inclined front has an angle of inclination provided by attachment of the upper end of the inclined front to the top of the back wall and attachment of the lower end of the inclined front to the front end of the bottom. The inclined front wall has an opening through it which is above an imagined horizontal median line. The back wall has vertically attached to it, a rounded post.

Another embodiment of this invention is provided by combining (A), one or more wall-like retainer segments described above and (B), one or more supports for the wall-like retainer segment.

Still another embodiment of this invention is provided by combining (A) and (B) segments wherein (A) is one or more wall-like retainer segments described above comprising a generally rectangular hollow body having a top wall, a bottom wall, a front wall, a back wall, a post end wall and an opposite end wall wherein the top wall has two, essentially identical openings through it, and wherein each of the openings is located near each of the said ends.

The bottom wall has two, essentially identical openings through it and each of the bottom openings is in vertical alignment with one of the top openings so as to receive a post therein.

The post end wall has vertically attached to it, a rounded post and the opposite end wall has a vertically aligned post opening in it to receive such a post.

The back wall has two vertically aligned post openings in it and each said back wall vertically aligned post opening is located between an end wall and the top opening near that end wall.

The segments (B) are supports for the wall-like retainer segment, the supports have a bottom wall, which has a back end and a front end, a back wall having a top and a bottom and a back, an inclined front wall having an upper end and a lower end and two, essentially identical, side walls.

The inclined front has an angle of inclination provided by attachment of the upper end of the inclined front to the top of the back wall and attachment of the lower end of the inclined front to the front end of the bottom wall. The inclined front wall has an opening through it above an imaginary horizontal median line and the back wall has vertically attached to it, a rounded post.

DETAILED DESCRIPTION OF THE DRAWINGS WITH REGARD TO THE INVENTION

Figure 1:
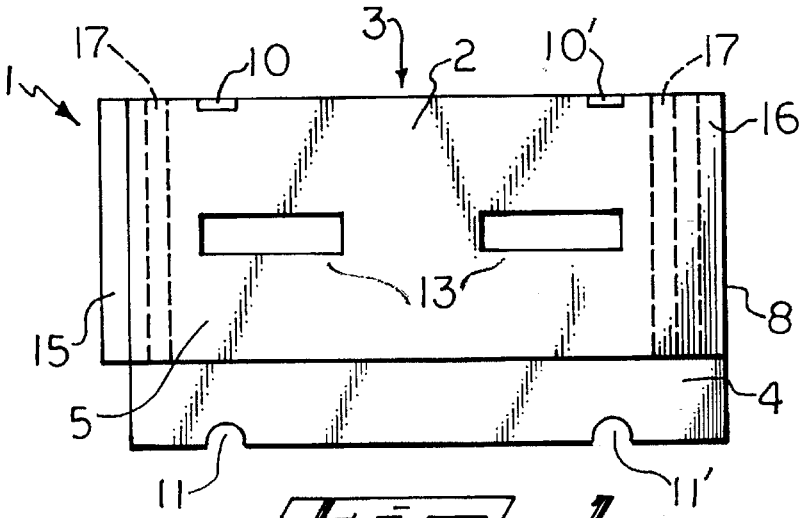
FIG. 1 is a full side view of a wall-like segment of this invention showing a wedge shaped bottom wall.

For purposes of illustrating and disclosing the invention herein to those skilled in the art, and with regard to FIG. 1, there is shown a full side view of a wall-like segment 1 of this invention showing a rectangular hollow body 2 having a top wall 3, a bottom wall 4, a front wall 5, a back wall 6 (shown in FIG. 2), a post end wall 7 and an opposite end wall 8.

Figure 3:
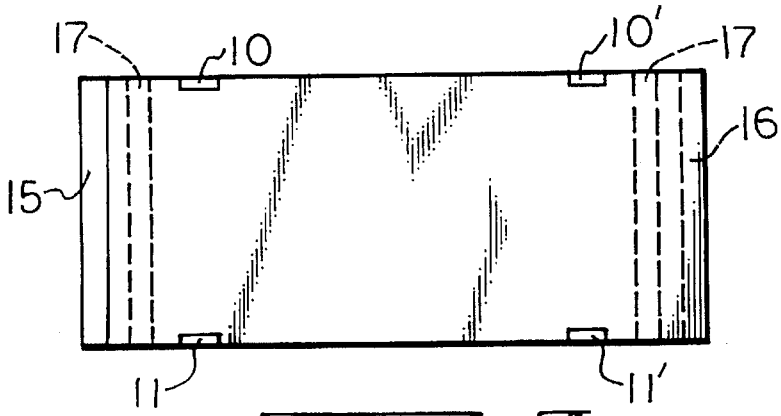
FIG. 3 is a full side view of a wall-like segment of this invention showing a flat shaped bottom wall.

It will be noted that the bottom wall 4 in FIG. 1 is wedge shaped. The wedge shaped bottom 4 is intended to be useful in soft sand, wet soil and the like and is intended to help stabilize the wall-like segment 1 in such a situation. Wall-like segments 1 can also have a flat bottom 9 as is illustrated in FIG. 3.

The top wall 3 of segment 1 has two, essentially identical openings 10 and 10' through it. Each of the openings 10 and 10' are preferably located near the ends of the wall segment 1, although these openings 10 and 10' can be located anywhere along the top wall 3.

Figure 5:
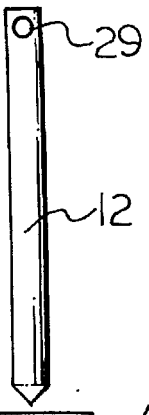
FIG. 5 is a full view of a stake useful in this invention.
Figure 4:
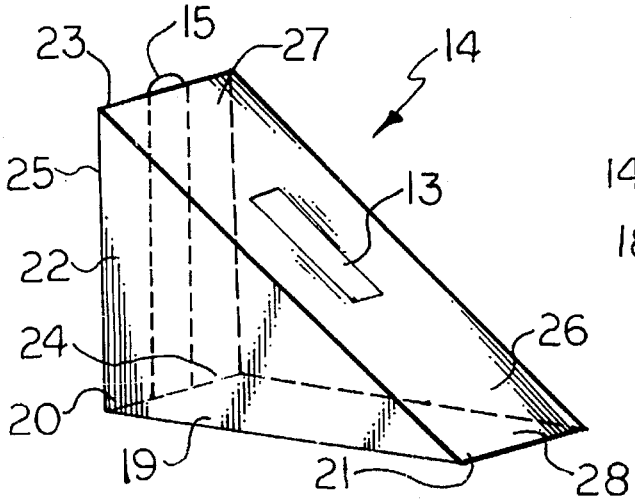
FIG. 4 is an isometric view of a support segment of this invention.

There is also shown in the bottom wall 4, two essentially identical openings 11 and 11'. The openings 11 and 11' are vertically aligned with the openings 10 and 10', respectively, to allow the insertion of a stake 12, which is shown in FIG. 5.

The material that is used in the fabrication of the segments of this invention are pliable plastics such that when a preformed stake 12 is inserted through the openings 10 and 11, or 10' and 11', the wall segments 1 will have essentially a tight fit around the stake 12 to prevent the loss of any water used to weight the wall segment 1.

The front wall 5 has at least two openings 13 through it and these openings 13 should tend to be above an imaginary horizontal median line 50—50 so that any substantial amount of water can be contained in the wall segment 1. If the openings 13 are too low, then generally not enough water can be stored to create the necessary weight for the wall segment to be held in place. Further, if these wall segments 1 are used in water containment conditions without the use of a liner, i.e. flood control, the openings 13 should be placed facing the flood water such that the openings 13 can take on flood water and continue to bear sufficient amount of weight to be held in place. It should be noted that the support 14 also has such an opening 13 for the same purpose.

In the event that the wall segments 1 and/or 18 (wall segment 18 is discussed in detail infra) are to be moved, the wall stakes 12 can be removed, and the water will drain from the bottom wall openings 11 and 11'. Removal of the stakes 12 can be facilitated by use of the hole 29 (FIG. 5) or the removal can be facilitated by drawing a bar through the hole to provide lifting supports therethrough, although, the inventor herein contemplates that no such facilitation is required.

Figure 2:
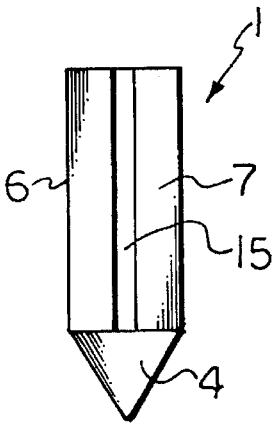
FIG. 2 is a full end view of the wall-like segment of FIG. 1 showing the post end.

The wall segments 1 and/or 18 and the supports 14 are interconnectable with each other and with regard to the wall segment 1 and with reference to FIGS. 1 and 2, it can be observed that there is provided a crude elongated type of connection which is comprised of a pole 15 rigidly mounted strategically in a vertical orientation on the post end wall 7. On the opposite end wall 8, there is provided a receptor 16 for the pole 15, which receptor 16 is rigidly affixed to the interior of the wall segment 1. When constructing the inventive system described infra, the pole 15 is inserted in the receptor 16 (shown in phantom in FIG. 1) which creates an elongated crude ball and socket joint which allows for some freedom of lateral movement of the wall segments 1 and any wall segment 1 joined therewith, or support 14 that is joined with any wall segment 1.

In addition, there is provided in the back wall 6 of each wall segment 1, at least two additional receptors 17 (also shown in phantom in FIG. 1) which are available for the joining of another wall segment 1, or for the joining of supports 14 to such wall segments 1 to form systems. The inventor herein has expressed the need for at least two such supports 14 as is illustrated herein, but the inventor contemplates that more than two such support 14 could be used, as long as the wall segment 1 is fabricated with the necessary amount of receptors 17 to accommodate such supports 14.

Also contemplated within the scope of this invention is the wall segment 18, shown in FIG. 3. The wall segment 18 is differentiated from the wall segment 1 by virtue of the fact that no openings 13 are present in the front wall 5. This wall segment 18 is used when it is determined to construct a system with the segments of this invention which are intended to be a supporting wall for a pool and the like. Obviously, the system would have to have a liner of some type to hold the water, as this invention only provides the supporting structure for such a liner.

The support 14 of this invention is comprised of a bottom wall 19, which has a back end 20 and a front end 21, a back wall 22, having a top 23 and a bottom 24. There is also a back surface 25 which is not shown, and in addition, there is an inclined front wall 26 having an upper end 27 and a lower end 28. The degree of inclination is not critical, the most significant factor being one in which there is sufficient bottom wall surface to stabilize the support 14 when it is filled with water. The angle of inclination is provided by fastening the upper end 27 of the front wall 26 to the top 23 of back wall 22 and the lower end 28 of the front wall 26 to the front end 21 of the bottom wall 19. Additionally, there is shown a pole 15 attached firmly to the back surface of the back wall 22.

Figure 6:
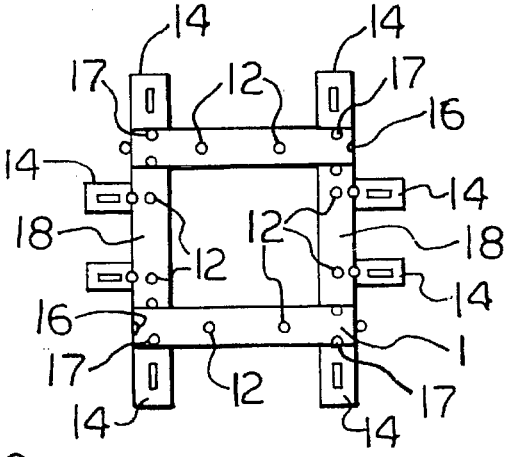
FIG. 6 is a top view of an arrangement of the wall-like segments and supports in a system to form a support for a pool.

Turning now to FIG. 6, there is shown the wall segments 1 and 18, supported by supports 14 all of which are interconnected by the poles 15 and receptors 16 and 17 to form a square support system for a pool. Stakes 12 are also shown in the openings 10 and 10' (which are not shown) to hold and stabilize the system. This system is now ready for a pool liner or the like, the pool liner not forming any part of this invention.

The system used in this manner, for example, can be taken apart and stored for winter storage. This type of construction provides a savings that would be incurred in the cost of constructing a cement block or cement poured or sprayed type of pool.

It should be noted by those skilled in the art that just about any configuration can be obtained by the use of the segments and supports of this invention and thus, the wall-like segments can be connected together in a linear arrangement to provide a long flood retaining wall or traffic barrier.

Suitable materials for fabrication of the wall segments 1 and 18 and the support 14 are tough, flexible plastics such as polypropylene, polyethylene, styrene and the like.

Also contemplated within the scope of materials useful for construction herein, are crosslinked polyethylene. Stakes 12 useful herein are fabricated from wood, metal, tough plastics and the like, depending on the end use thereof.

What is claimed is:

1. A wall-like retainer segment comprising a generally rectangular hollow body having a top wall, bottom wall, front wall having a horizontal median line, back wall, post end wall and an opposite end wall;

said top wall having two, essentially identical openings therethrough, each of said openings being located near each of the said ends;

said bottom wall having two, essentially identical openings therethrough, each said bottom opening being in vertical alignment with one of the top openings;

the post end wall having vertically fixedly attached thereto, a rounded post;

the opposite end wall having a vertically aligned post opening therein;

the front wall having two, essentially identical openings therethrough, said front wall openings located above the front wall horizontal median line;

said back wall having two vertically aligned post openings therein, each said back wall vertically aligned post opening being located between an end wall and the top opening near that end wall.

2. A support for a wall-like retainer segment said support having a bottom wall, having a back end and a front end, a back wall having a top and a bottom and a back, an inclined front wall having an upper end and a lower end and a horizontal median line, and two, essentially identical, side walls;

said inclined front having an angle of inclination provided by attachment of the upper end of the inclined front to the top of the back wall and attachment of the lower end of the inclined front to the front end of the bottom; said inclined front wall having an opening therethrough above the horizontal median line; said back wall having vertically fixedly attached thereto, a rounded post.

3. In combination, (A) a wall-like retainer segment comprising a generally rectangular hollow body having a top wall, bottom wall, front wall having a horizontal median line, back wall, post end wall and an opposite end wall;

said top wall having two, essentially identical openings therethrough, each of said openings being located near each of the said ends;

said bottom wall having two, essentially identical openings therethrough, each said bottom opening being in vertical alignment with one of the top openings;

the post end wall having vertically fixedly attached thereto, a rounded post;

the opposite end wall having a vertically aligned post opening therein;

the front wall having two, essentially identical openings therethrough, said front wall openings located above the front wall horizontal median line;

said back wall having two vertically aligned post openings therein, each said back wall vertically aligned post opening being located between an end wall and the top opening near that end wall and, (B) a support for the wall-like retainer segment said support having a bottom wall, having a back end and a front end, a back wall having a top and a bottom and a back, an inclined front wall having an upper end and a lower end and a horizontal median line, and two, essentially identical, side walls;

said inclined front having an angle of inclination provided by attachment of the upper end of the inclined front to the top of the back wall and attachment of the lower end of the inclined front to the front end of the bottom wall; said inclined front wall having an opening therethrough above the horizontal median line; said back wall having vertically fixedly attached thereto, a rounded post.

4. In combination, (A) a wall-like retainer segment comprising a generally rectangular hollow body having a top wall, bottom wall, front wall, back wall, post end wall and an opposite end wall;

said top wall having two, essentially identical openings therethrough, each of said openings being located near each of the said ends;

said bottom wall having two, essentially identical openings therethrough, each said bottom opening being in vertical alignment with one of the top openings;

the post end wall having vertically fixedly attached thereto, a rounded post;

the opposite end wall having a vertically aligned post opening therein;

said back wall having two vertically aligned post openings therein, each said back wall vertically aligned post opening being located between an end wall and the top opening near that end wall and, (B) a support for the wall-like retainer segment said support having a bottom wall, having a back end and a front end, a back wall having a top and a bottom and a back, an inclined front wall having an upper end and a lower end and a horizontal median line, and two, essentially identical, side walls;

said inclined front having an angle of inclination provided by attachment of the upper end of the inclined front to the top of the back wall and attachment of the lower end of the inclined front to the front end of the bottom wall; said inclined front wall having an opening therethrough above the horizontal median line; said back wall having vertically fixedly attached thereto, a rounded post.

5. The combination as claimed in claim 4 when used as a support for a swimming pool.

6. The combination as claimed in claim 4 when used for controlling liquids.

7. The combination as claimed in claim 4 when used for revetment.

* * * * *